US005379908A

United States Patent [19]

Rohe

[11] Patent Number: 5,379,908

[45] Date of Patent: Jan. 10, 1995

[54] PLASTIC CLOSURE CAP, IN PARTICULAR FOR GLASS CONTAINERS

[75] Inventor: Karlheinz Rohe, Bad Driburg, Germany

[73] Assignee: F.E.S. Kunststoff GmbH, Paderborn, Germany

[21] Appl. No.: 83,976

[22] Filed: Jun. 28, 1993

[30] Foreign Application Priority Data

Oct. 28, 1991 [DE] Germany ..... 4135470

[51] Int. Cl.[6] ..... B65D 41/40

[52] U.S. Cl. ..... 215/249; 215/254

[58] Field of Search ..... 215/249, 251, 254

[56] References Cited

U.S. PATENT DOCUMENTS 4,271,972 6/1981 Thor ..... 215/251

5,085,332 2/1992 Gettig et al. ..... 215/249

FOREIGN PATENT DOCUMENTS 8805665.1 8/1988 Germany ..... 215/249

*Primary Examiner*—S. Castellano

*Attorney, Agent, or Firm*—Herbert L. Lerner; Laurence A. Greenberg

[57] ABSTRACT

A plastic closure cap, especially for glass containers, includes a lid part to be pulled off exposing a seal or an opening. A sleeve part surrounds a bottle neck of the container. Grippers are secured on the sleeve part and are pivotal at material weak points at the sleeve part. The grippers abut one another in flush fashion in a closing position and are joined to make a closed surface encompassing the bottle neck. The grippers have sides pointing toward one another. The grippers are rectangular as seen in a plan view and curved as seen in cross section. Tabs are associated with the grippers. The sides of the grippers and the tabs face one another and have alternating profiling mutually complementing one another in the closing position. The sides of the grippers are beveled toward the inside and overlap one another in the closing position.

12 Claims, 3 Drawing Sheets

PLASTIC CLOSURE CAP, IN PARTICULAR FOR GLASS CONTAINERS

CROSS-REFERENCE TO RELATED APPLICATION

This application is a continuation of International Application Ser. No. PCT/DE92/00887, filed Oct. 23, 1992.

BACKGROUND OF THE INVENTION

1. Field of the Invention

The invention relates to a plastic closure cap, particularly for glass containers, with a range of applications. The plastic closure cap has pivoting grippers located on a sleeve part surrounding a bottle neck, the grippers have gripping edges which abut one another in flush fashion in the closing position, and which overlap one another and are joined in a force-locking and form-locking fashion to make a closed surface encompassing a bottle neck, and a cap part exposing a seal or opening has a formed-on gripper part being used for opening. A force-locking connection is one which connects two elements together by force external to the elements, as opposed to a form-locking connection which is provided by the shapes of the elements themselves.

In one such closure cap, that is known from German Published, Prosecuted Application DE 23 27 553 B2, the closure part is formed by an encompassing bead formed onto the sleeve part on the inside, which can be constructed in such a way as to not be especially thick.

When the cap is mounted on the bottle neck, the cap region carrying the encompassing bead needs to be widened outward so that it can engage over the undercut edge of the bottle neck and lock into place there. The widening does not assure a secure snap-type connection between the cap bead and the undercut edge of the bottle neck.

A version known from German Petty Patent DE 88 05 665 U1 is also constructed in multiple parts, resulting in greater weight of the cap.

A version known from German Petty Patent DE 84 05 233 U1 is also constructed with expansion aids in the closure part, so that the material will not tear when expanding during sterilization.

When the cap part is torn open, an undesired burr is thus created in the surface of the closure cap, where possible residues of foreign substances may stick during later use.

A version known from Published European Application No. 02 42 453 A2 is also in multiple parts and must be flanged over at the undercut part of the bottle to provide a secure seat.

When that closure cap is manufactured, the lid part is also made of plastic which prevents difficulties in terms of the recycling of raw materials.

2. Summary of the Invention

It is accordingly an object of the invention to provide a plastic closure cap, in particular for glass containers, which overcomes the hereinafore-mentioned disadvantages of the heretofore-known devices of this general type, which necessarily offers a useful addition so that in terms of manufacture it is more favorably constructed and in the closing process can be closed more rationally, and in which the expense for the complete closure cap is reduced.

With the foregoing and other objects in view there is provided, in accordance with the invention, a plastic closure cap, in particular for glass containers, comprising a lid part to be pulled off exposing a seal or an opening; a sleeve part surrounding a bottle neck of a container; grippers being secured on the sleeve part and pivotal at material weak points at the sleeve part, the grippers abutting one another in flush fashion in a closing position and being joined to make a closed surface encompassing the bottle neck, the grippers having sides pointing toward one another, and the grippers being rectangular as seen in a plan view and curved as seen in cross section; tabs associated with the grippers; the sides of the grippers and the tabs facing one another having alternating tab profiling mutually complementing one another in the closing position; and the sides of the grippers being beveled toward the inside and overlapping one another in the closing position.

The subject of the invention extends not only to the characteristics of the individual claims but also to their combination.

In order to be attached to the bottle neck, the closure cap is constructed in such a way that it has weak points in the material on the closure cap that are constructed to suit bottling technology, and formed-on hooks, tabs and grippers. These hooks, tabs and grippers are disposed in such a way that upon axial opening of the die mold they can be expelled in the injected state without being destroyed or deformed.

It is not until the caps are sealed to the bottle neck that the hooks, tabs and grippers are pivoted downward in such a way that they engage the underside of the undercut bottle neck edge. The hooks, tabs and grippers are side by side in such a position that at the end of the closing process, they are joined over a large area and are flush. They are joined in a force-locking and form-locking way to make a closed surface encompassing the bottle neck, and this surface may be constructed in various geometric shapes. As a result of the construction of the cap in this form in the die, it has a relatively short structure for manufacturing purposes and can be expelled from the die mold easily, with a high Nester number.

The force-locking and form-locking connection of the hooks, tabs and grippers that are located next to one another may be provided in such a way that they are welded by ultrasound next to one another, one above the other, or in combined form, or by means of small locking hooks and receptacles in various geometric shapes and in combination with the tabs that are located one above the other, they do not allow the seal to be opened without being destroyed.

The closure cap may be used for the various bottles as defined by DIN in the various embodiments. It is especially suitable for a secure seal for media enclosed in closed glass containers that are under high pressure.

At the same time, the closed cap offers a warranty seal as proof of intactness and need not be flanged over afterward or provided with an attached warranty indication, as has become known for other closures.

It is also possible for the material weak point formed on the closure cap in some manner appropriate for bottling to be constructed in such a way that by way of it, tearing open and opening can be performed without the closure cap and the closing part being lost from the bottle.

Other features which are considered as characteristic for the invention are set forth in the appended claims. In accordance with a further feature of the invention, the lid part has an inner surface with an annular clamping lip protruding downward, having a periphery protruding outwardly.

Although the invention is illustrated and described herein as embodied in a plastic closure cap, in particular for glass containers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 2:
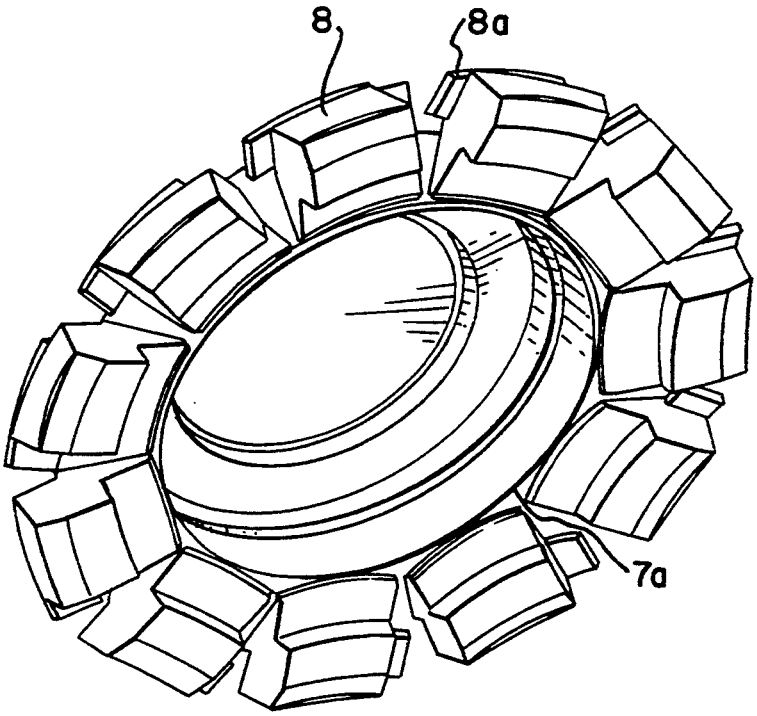
FIG. 2 is a perspective view of a closure cap as seen in a plan view from below in terms of FIG. 1.
Figure 3:
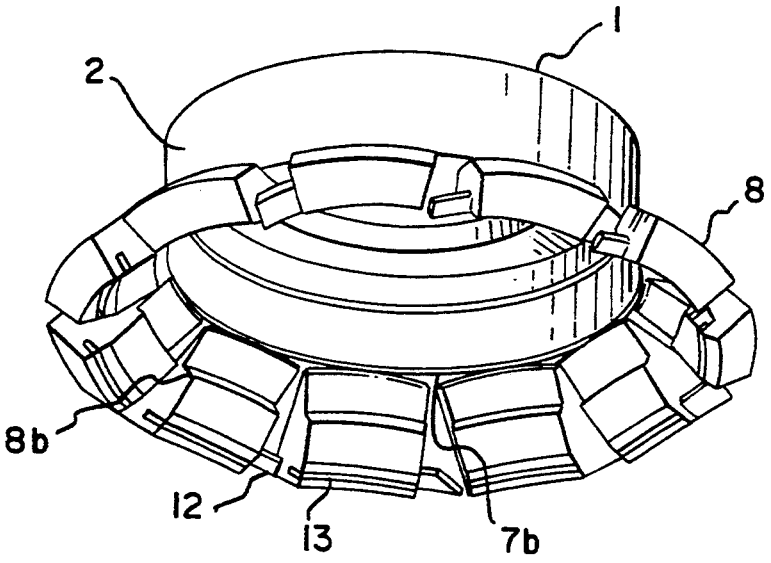
FIG. 3 is a perspective view of a closure cap as seen from the front with small formed-on locking hooks and receptacles, shortly before the closure.
Figure 4:
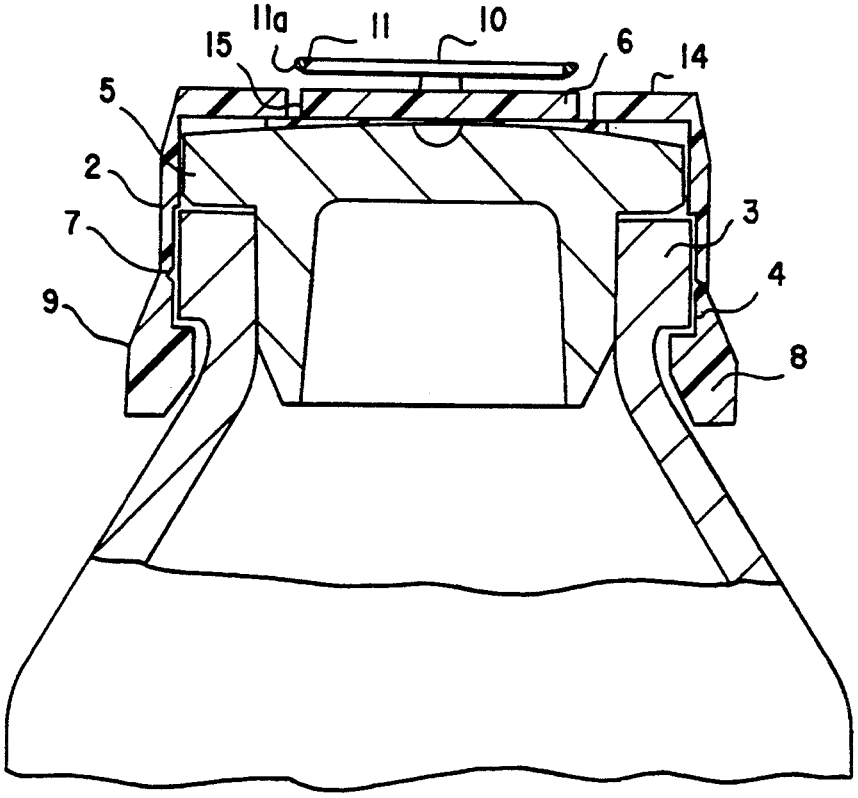
FIG. 4 is a fragmentary, vertical-sectional view of a closure cap on a bottle neck with a rubber seal and injection-molded small closure lids with a gripper part.
Figure 5:
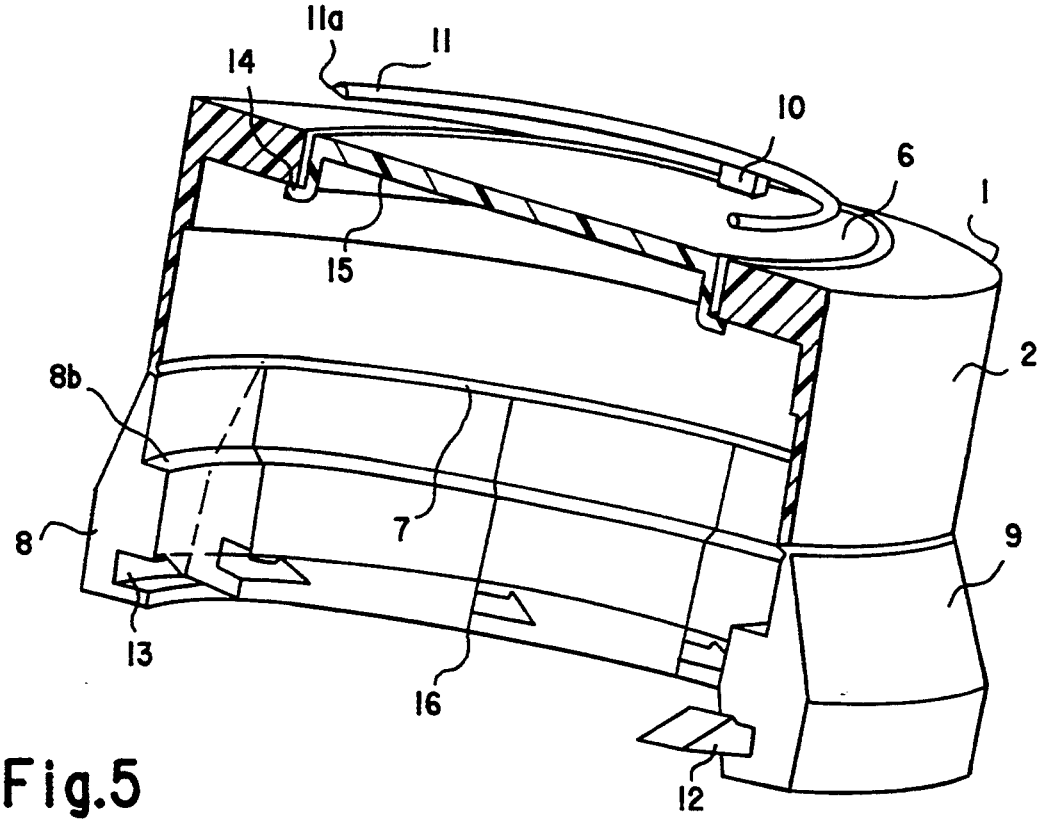
FIG. 5 is a fragmentary, perspective view of a vertical section of a closure cap in a closed, tight-seam state with locking hooks and receptacles and injection-molded small closure lids with a gripper part, and a clamping lip being located in a folded-over state.

Referring now in detail to the figures of the drawing as a whole, it is seen that a plastic closure cap 1 including a sleeve part 2 shown in FIGS. 1–5 surrounding a bottle neck 3 shown in FIG. 4, has a surface encompassing closing part 9 seen in FIGS. 4 and 5 engaging underneath an undercut edge 4 seen in FIG. 4 of the bottle neck 3, and has a lid part 6 seen in FIGS. 4 and 5 that can be torn off and exposes a seal 5 shown in FIG. 4.

The surface encompassing closing part 9 of FIGS. 4 and 5 is constructed with a sufficient number of grippers 8 and gripping edges **8*b*, disposed in the sleeve part 2 of FIGS. 1–5, to ensure that the secured hooking, gripping edges and grippers are joined over a large area and are flush, as is seen in FIG. 5, in the closing position behind the undercut bottle neck edge 4 of FIG. 4**.

Figure 1:
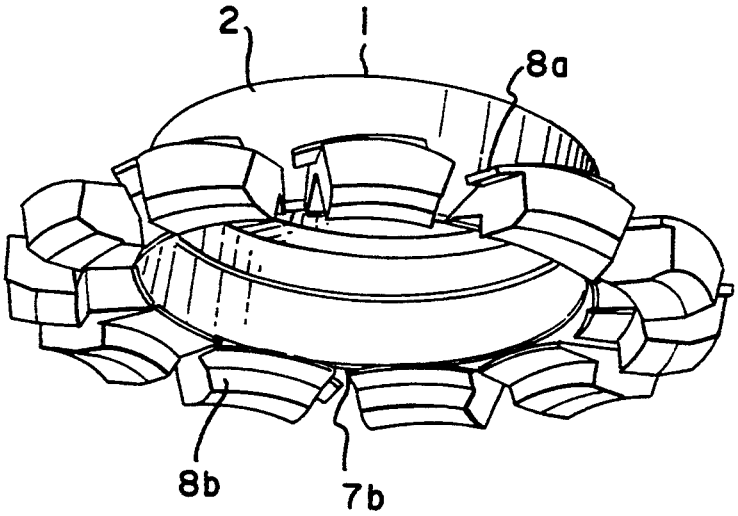
FIG. 1 is a diagrammatic perspective view of a closure cap as seen from the front, with a formed-on closing part and overlapping receptacles in the manufactured version.

In the embodiment of FIGS. 1–5, the grippers 8 and gripping edges **8*b* are integrally joined to the sleeve 2 through formed-on material weak points 7 seen in FIGS. 1–5, so that upon closure from the horizontal to the vertical position, a closed material weak point, especially at points 7*b* of FIGS. 1 and 3, is assured, without causing pinching of material. Material pinching can also be averted by making notches at a point 7*a* seen in FIG. 2**.

The grippers 8 which are pivotable in these formed-on material weak points 7 counter to the bottle neck 3 of FIG. 4 are constructed in such a way that upon the termination of the closing process, they are joined over a large area and are flush to form the surface encompassing closing part 9 seen in FIG. 5 that is closed in force-locking and form-locking fashion and encompasses the bottle neck 3 of FIG. 4. The grippers 8 have seams 16 seen in FIG. 5. The surface encompassing closing part 9 may be constructed in various geometric shapes.

The lid part 6 seen in FIGS. 4 and 5 is equipped with a gripper part 10 in order to pull the lid part out of the closure cap, and is constructed cylindrically at an inner periphery 11 of FIG. 4 and comes to an end in an outer periphery **11*a***, inwardly toward the inner periphery in curved and chamfered fashion or in a combination thereof.

The lid part 6 is formed onto the closure cap 1 in such a way that in an inner part 15 of the lid 6 seen in FIG. 4, it has a thin-walled clamping lip 14 seen in FIG. 4 that points downward or to the side and is constructed in various geometric shapes, and that in the process of closing the cap onto the bottle neck bends over downward or upward and thus rests clampingly and sealingly on the lower edge of the cap or in the inner part of the bottle.

FIGS. 1 and 2 show the manufactured starting form of the closure cap 1, wherein the curved grippers 8 are located in a horizontal plane and protrude outward from the sleeve part 2.

At the points **7*a* seen in FIG. 2, the necessary notches or weak points or accumulations of material 7*b* of FIGS. 1 and 3** can be seen, in order to ensure that material squeezing will not occur in the sealing process.

In order to seal the bottle neck 3, the closure cap is mounted on it, and then the grippers 8 are pressed downward against the bottle neck 3 by way of their suitably preformed material weak points 7 seen in FIG. 4. This preforming is necessary so that no white breakage occurs upon pivoting from the horizontal to the vertical position. In the closing position, the closed, flush surface encompassing closing part 9 seen in FIG. 5 for encompassing the bottle neck, has also been produced.

The closure cap of FIGS. 3–5 is equivalent in its basic layout and principle to the closure cap of FIGS. 1 and 2, and the same reference numerals are therefore used for identical parts.

The formed-on material weak point 7 and material accumulations constructed at the points **7*b* of FIGS. 1 and 3 can be clearly seen from them. FIGS. 1 and 2 show an alternating offset tab 8*a* of the tabs, which is necessary to ensure that in the sealing state the grippers 8 that are each located next to one another will overlap and can thus be necessarily welded with ultrasound, so that the surface encompassing closing part 9 of FIGS. 4 and 5 that is closed over a large area and is flush and encompasses the bottle neck 3** will be produced.

The grippers may also be constructed in such a way as to produce tabs and recesses in the form of alternating side-by-side grippers with locking hooks or tabs 12 and locking receptacles or recesses 13 seen FIGS. 3 and 5, in various geometric shapes, and their combination with the alternating overlapping tabs to make the surface encompassing closing part 9 seen in FIGS. 4 and 5 around the bottle neck 3 of FIG. 4.

I claim:

1. A plastic closure cap for a container with a bottle neck, comprising:

a sleeve part surrounding the bottle neck of the container;

a lid part attached to said sleeve part to be pulled off exposing an opening defined by said sleeve part;

grippers being secured on said sleeve part and pivotal about a substantially horizontal axis at material weak points at said sleeve part, said grippers abutting one another in flush fashion in a closing position and being joined to make a closed surface encompassing the bottle neck, each of said grippers having first and second sides, said first side of said grippers pointing toward said second side of a respectively adjacent gripper, and said grippers being rectangular as seen in the elevation view and curved as seen in horizontal cross section in the closing position;

tabs associated with said first sides of said grippers; said tabs having a tab profiling;

said second sides of said grippers having recesses formed therein for receiving said tabs in the closing position, said recesses having a profiling complementing said tab profiling for nesting said tabs in respective ones of said recesses; and said first and second sides of said grippers being beveled radially inwardly and tightly abutting one another in the closing position.

2. The closure cap according to claim 1, including a seal being exposed when said lid part is pulled off.

3. The closure cap according to claim 1, wherein said grippers have inwardly oriented gripping edges.

4. The closure cap according to claim 1, wherein said tab profiling and said profiling on said second sides includes hooks and receptacles alternatingly complementing one another, meshing with one another and being locked together.

5. The closure cap according to claim 1, wherein said grippers and said tabs are welded together by ultrasound at connection points in the closing position.

6. The closure cap according to claim 1, wherein said grippers have corners being notched at connecting points between said sleeve part and said grippers.

7. The closure cap according to claim 1, wherein said material weak points have a formed-on chamfer on outer and inner peripheries at connecting points between said sleeve part and said grippers.

8. The closure cap according to claim 1, wherein said lid part has an inner surface with annular clamping lip protruding annularly downward, having a periphery protruding outwardly.

9. The closure cap according to claim 1, wherein said lid part has an outer periphery with a ring formed thereon said ring being cylindrical at an inner periphery thereof.

10. The closure cap according to claim 1, wherein said grippers and said tabs extend horizontally and are formed onto said sleeve part.

11. The closure cap according to claim 1, wherein said grippers engage the bottle neck from below on all sides in the closing position, and form an unloosenable closing part.

12. The closure cap according to claim 1, wherein said grippers have corners being cut away at connecting points between said sleeve part and said grippers.

* * * * *